US009877882B2

(12) United States Patent
Stewart

(10) Patent No.: US 9,877,882 B2
(45) Date of Patent: Jan. 30, 2018

(54) WHEELCHAIR TRANSFER HANDRAIL

(71) Applicant: Timothy Wayne Stewart, Forney, TX (US)

(72) Inventor: Timothy Wayne Stewart, Forney, TX (US)

( * ) Notice: Subject to any disclaimer, the term of this patent is extended or adjusted under 35 U.S.C. 154(b) by 28 days.

(21) Appl. No.: 15/132,483

(22) Filed: Apr. 19, 2016

(65) Prior Publication Data

US 2017/0296408 A1 Oct. 19, 2017

(51) Int. Cl.
*A61G 5/10* (2006.01)
*A61G 5/02* (2006.01)

(52) U.S. Cl.
CPC ..... *A61G 5/10* (2013.01); *A61G 5/02* (2013.01); *A61G 2203/78* (2013.01)

(58) Field of Classification Search
CPC ..... A61G 5/02; A61G 5/10; A61G 2203/78
USPC ..... 280/304.1
See application file for complete search history.

(56) References Cited

U.S. PATENT DOCUMENTS 2,872,967 A 11/1956 Kirkpatrick
3,405,954 A 7/1966 Wolfe
3,993,349 A 11/1976 Neufeld et al.
3,999,778 A 12/1976 Markiel
4,265,478 A * 5/1981 Korsgaard ..... A61G 3/0808 105/159
4,278,387 A 7/1981 Seguela et al.
4,365,924 A 12/1982 Brigman et al.
4,457,663 A 7/1984 Hems et al.
4,948,156 A 8/1990 Fortner
5,244,225 A 9/1993 Frycek
5,842,745 A 12/1998 Kelly et al.
6,648,359 B2 11/2003 Chen et al.
6,669,287 B1 12/2003 DeLilla
6,793,269 B2 9/2004 Pugh et al.
7,438,363 B1 10/2008 Sutherland
7,752,687 B1 7/2010 Denosky
7,891,619 B2 * 2/2011 Perlman ..... F16B 7/1418 248/229.14
8,172,023 B1 5/2012 Irvine
8,308,406 B2 * 11/2012 Parks ..... A61G 5/10 410/4
8,622,409 B2 1/2014 Hector, Jr. et al.
9,205,009 B2 12/2015 Koors et al.

* cited by examiner

*Primary Examiner* — Joseph M Rocca
*Assistant Examiner* — Felicia L. Brittman
(74) *Attorney, Agent, or Firm* — Daniel V. Thompson

(57) ABSTRACT

The present invention provides a wheelchair transfer handrail for use in connection with a wheelchair and a door striker on a vehicle pillar. The invention includes a clamp assembly connected to the wheelchair, and a handrail tube extending from the clamp assembly to the door striker.

8 Claims, 8 Drawing Sheets

WHEELCHAIR TRANSFER HANDRAIL

BACKGROUND OF THE INVENTION

Field of the Invention

This invention relates to wheelchairs, and more particularly a handrail for a wheelchair.

Description of the Background Art

Transferring a person between a wheelchair and vehicle, and vice versa, is a difficult maneuver for many disabled persons and their caregivers. The difficulty is particularly acute for persons and caregivers new to wheelchair use, who have not yet become familiar with safe wheelchair practices, such as patients leaving a hospital with a temporary disability. In all instances, there is moment where the person is between the wheelchair and the vehicle with neither available for reliable support. Many times the person will grab the vehicle door, which is itself movable and unreliably supportive.

In many cases, a simple handrail between the wheelchair and vehicle would provide all the assistance needed to enable a safe transfer. A permanently deployed handrail, however, would interfere with normal wheelchair use.

A need therefore exists for wheelchair transfer handrail that can be quickly deployed when needed, yet compactly and securely stowed or removed when not in use.

SUMMARY OF THE INVENTION

The present invention provides a wheelchair transfer handrail for use in connection with a wheelchair and a door striker on a vehicle pillar. The invention includes a clamp assembly connected to the wheelchair, and a handrail tube extending from the clamp assembly to the door striker.

BRIEF DESCRIPTION OF THE DRAWINGS

A more complete understanding of the invention and its advantages will be apparent from the Detailed Description taken in conjunction with the accompanying Drawings, in which.

DETAILED DESCRIPTION OF THE INVENTION

Figure 1:
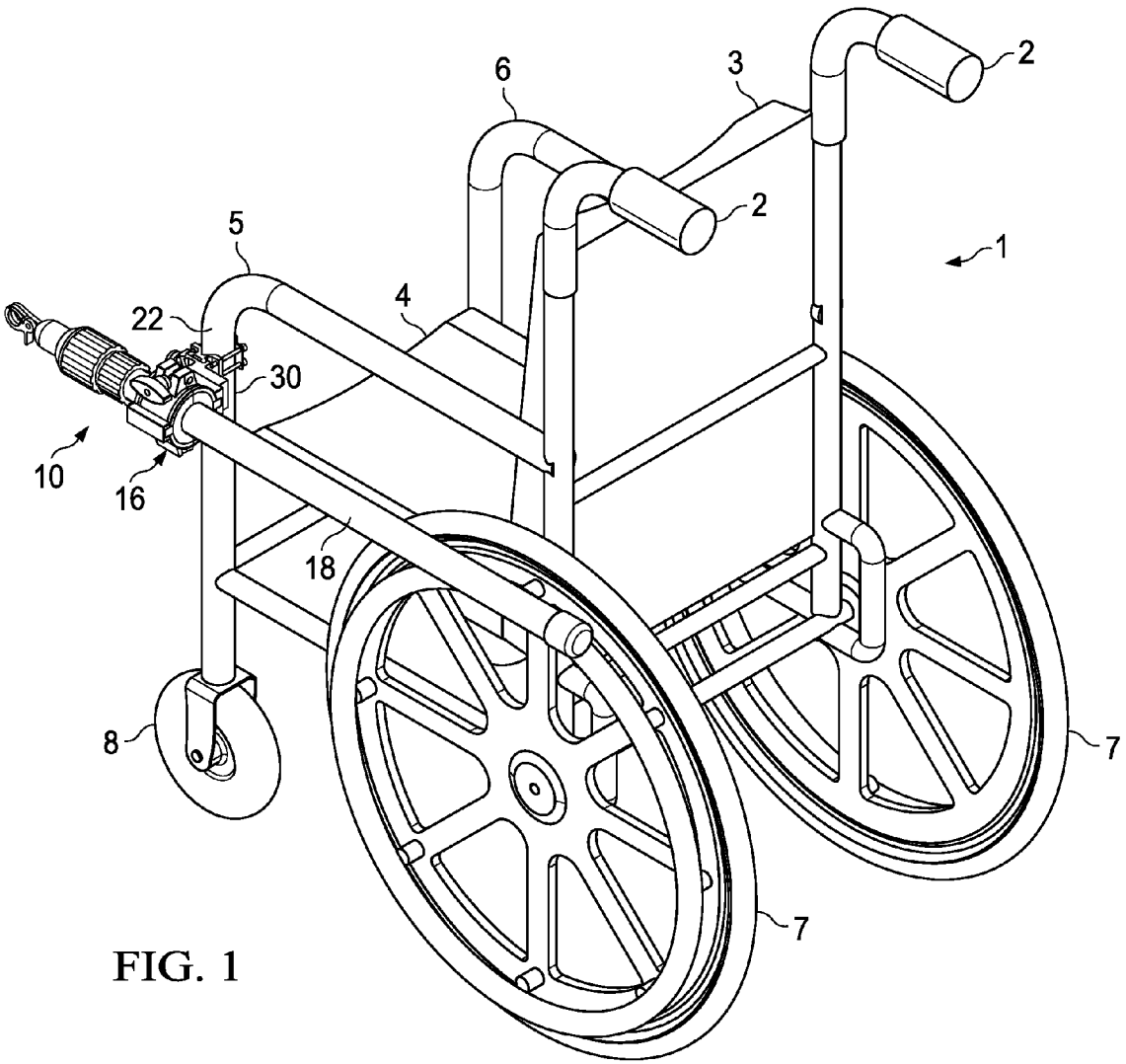
FIG. 1 is a perspective view of a wheelchair transfer handrail constructed in accordance with the invention connected to a wheelchair.
Figure 2:
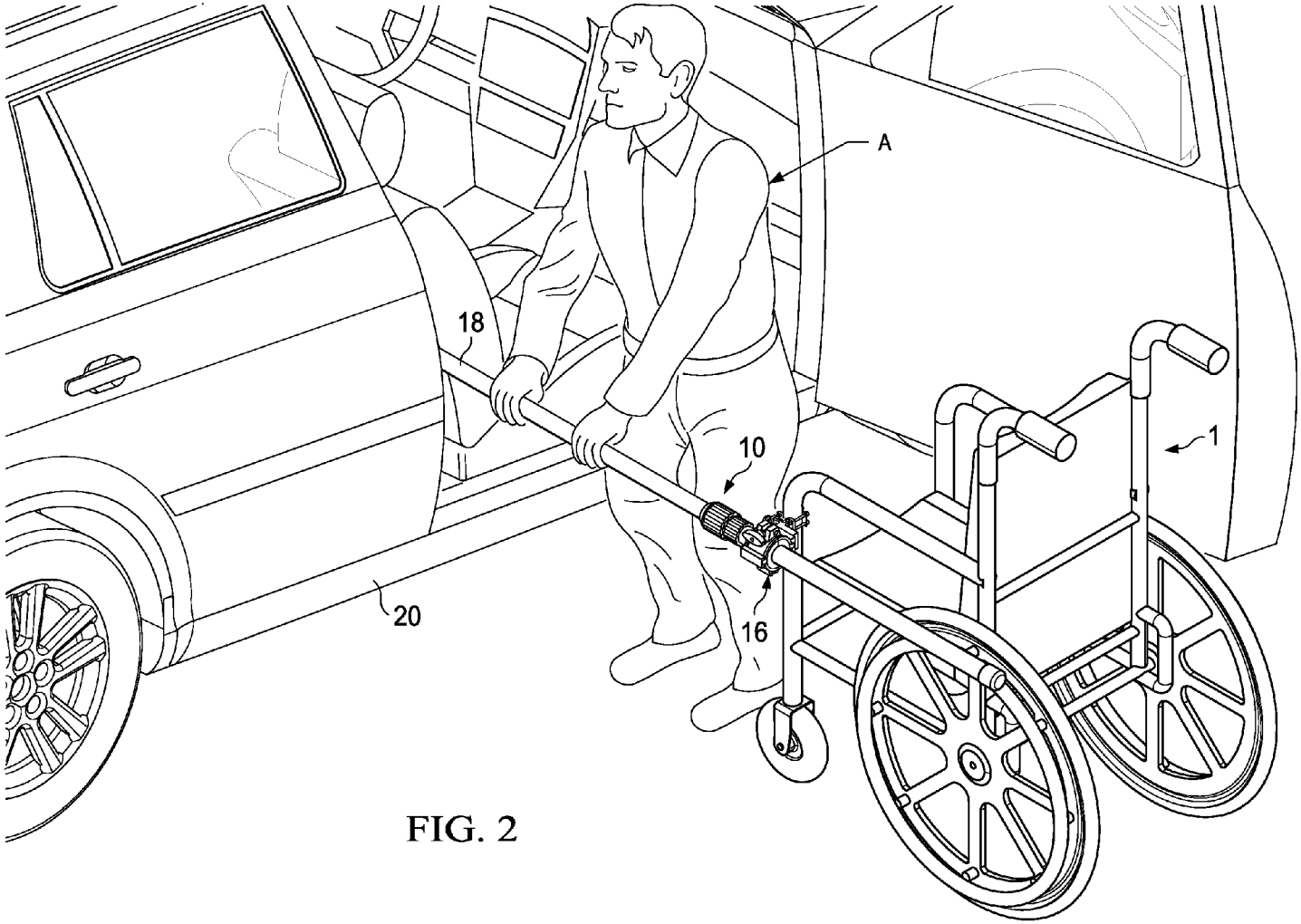
FIG. 2 is a perspective view of the wheelchair transfer handrail in operation.
Figure 3:
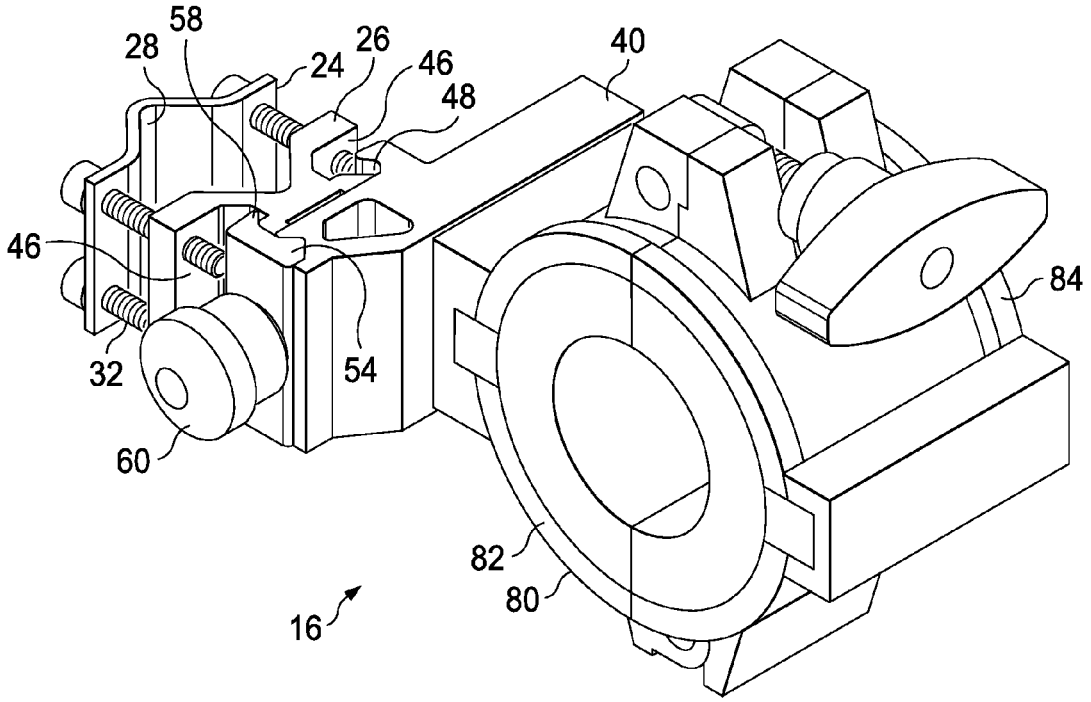
FIG. 3 is a perspective view of a clamp assembly used in the wheelchair transfer handrail.
Figure 4:
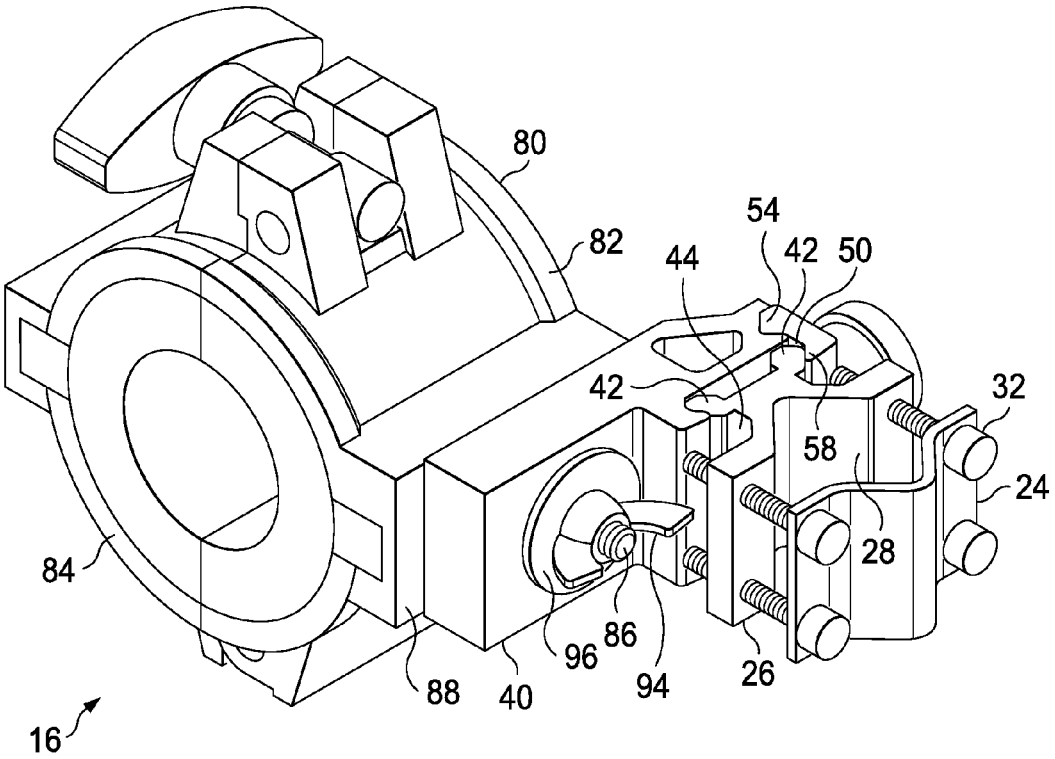
FIG. 4 is another perspective view of the clamp assembly.
Figure 5:
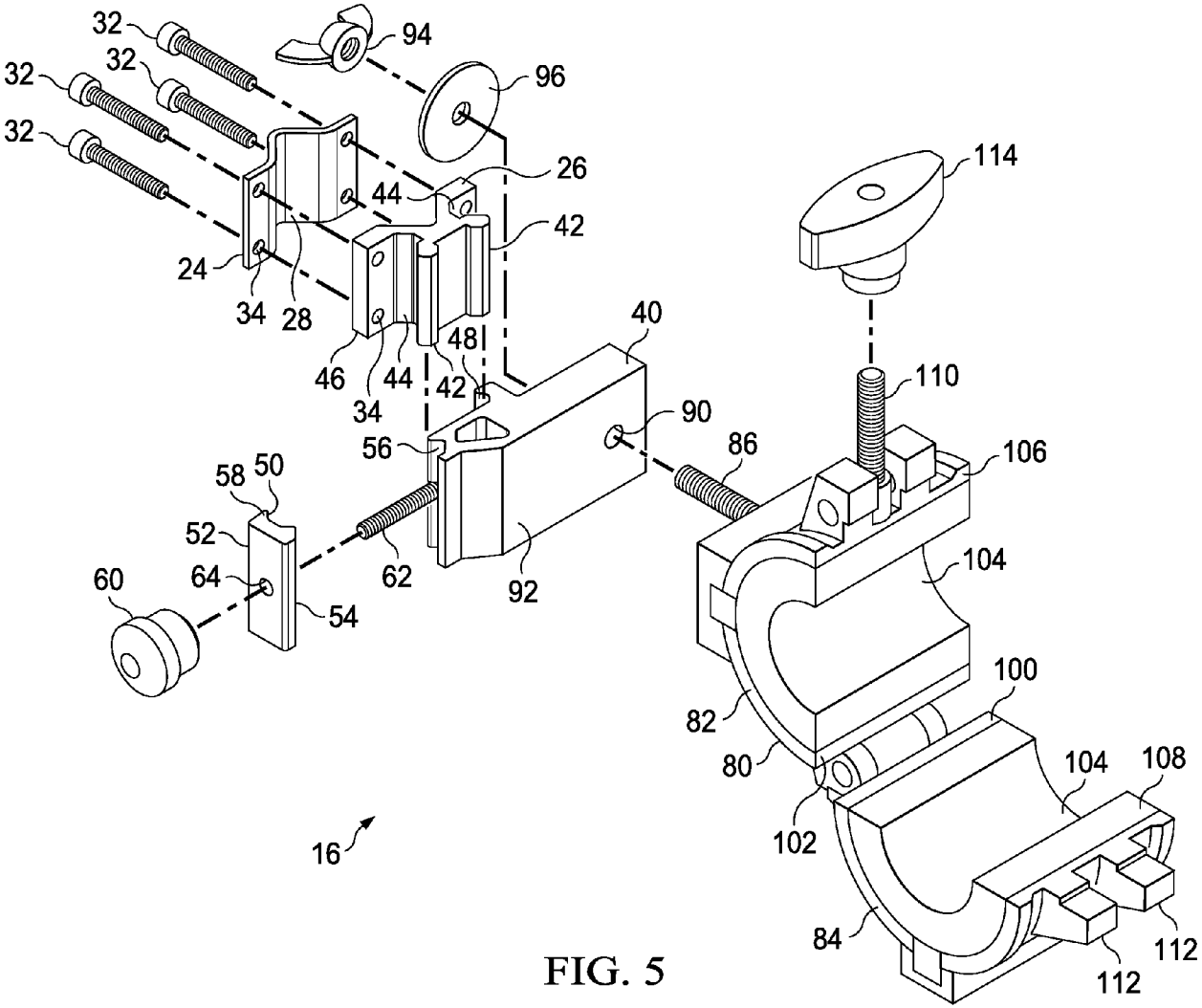
FIG. 5 is an exploded perspective view of the clamp assembly.

Referring to FIGS. 1-8, where like numerals indicate like and corresponding elements, a conventional wheelchair 1 includes push handles 2, backrest 3, seat 4, arm rests 5 and 6, wheels 7, and castor 8. A wheelchair transfer handrail 10 is connected to wheelchair 1. Wheelchair transfer handrail

10 provides a temporary connection between wheelchair 1 and a door striker 12*a* (FIG. 7) or 12*b* (FIG. 8) on a vehicle pillar 14.

"Pillar" is the commonly-known term for a vertical or near-vertical support of a vehicle's door and window areas. Pillars are designated respectively as the A, B, C or (in larger vehicles) D-pillar, moving from the front to rear, in profile view. "Door strikers" are commonly found on the B and C-pillars.

Door strikers are the fixed parts that are normally used in connection with the door latches. Door strikers are already designed for robust, load-bearing connection to the door pillars, because door latches are required by regulation to prevent unintended opening of the doors in collisions and roll-overs. A feature of the present invention is that it takes advantage of the door strikers that are already present in nearly all vehicles.

Wheelchair transfer handrail 10 includes a clamp assembly 16 connected to the wheelchair 1. A handrail tube 18 extends from clamp assembly 16 to vehicle 20, as will be described in detail to below. The clamp assembly 16 is connected to a vertical armrest support 22 of the wheelchair 1.

Clamp assembly 16 includes inner and outer clamp flanges 24,26. Each of the clamp flanges 24,26 has a V-shaped inner surface 28, with the inner surfaces 28 opposed to one another and sized to engage a tubular section 30 (FIG. 1) of the armrest support 22. Tighten-able fasteners 32 span between opposed openings 34 in the inner and outer clamp flanges 24,26. Fasteners 32 are tightened to clamp the flange inner surfaces 28 to the vertical armrest support tubular section 30.

The clamp assembly 16 further includes a base 40 connected to the outer clamp flange 26. The base 40 and outer clamp flange 26 have connector elements that enable ready connection and disconnection of the base 40 and outer clamp flange 26. The connector elements include a pair of opposing, parallel, longitudinal, ears 42 on the outer clamp flange 26 and opposing, parallel, longitudinal, medial grooves 44 between the ears 42 and flange portions 46 of the outer clamp flange 26. The connector elements further include a fixed channel 48 and a loosen-able channel 50 on the base 40. The fixed channel 48 grips one ear 42, and the loosen-able channel grips the other ear 42. The loosen-able channel 50 is formed by a channel plate 52 having a tongue 54 engaged with a groove 56 on the base and an extension 58 engaged with the other ear 42. A flange threaded knob 60 is engaged with a flange threaded rod 62 extending from the base 40 through an opening 64 formed in the channel plate 52.

The connector elements described in the preceding paragraph fix the base 40 to the outer clamp flange 26 when the flange threaded knob 60 is tight. The loosen-able channel 50 enables disconnection of the base 40 from the outer clamp flange 26, by sliding longitudinal motion, when the flange threaded knob 60 is loose. Ready connection and disconnection of the base 40 from outer clamp flange 26 is a very desirable feature of the invention, because while the clamp flanges 24,26 will be more or less permanently attached to the wheelchair, the clamp flanges are small enough to not intrude on normal everyday use of the wheelchair. Meanwhile, the portion of the wheelchair transfer handrail from the base outwards may be kept apart from the wheelchair until right before it is needed. The wheelchair transfer handrail will only be used occasionally, so even though it is relatively compact and lightweight, partial disconnection of the device from the base outwards will be desired.

A barrel clamp 80 is also connected to the base 40. The barrel clamp 80 has inner and outer halves 82,84, with the inner half 82 connected to the base 40 by way of a base threaded rod 86 extending from a planar surface 88 of the inner half 82 through an opening 90 formed in a planar surface 92 on the base 40. A base threaded fastener 94 is engaged with the base threaded rod 86 and tightened against the base 40 and optional washer 96.

Figure 6:
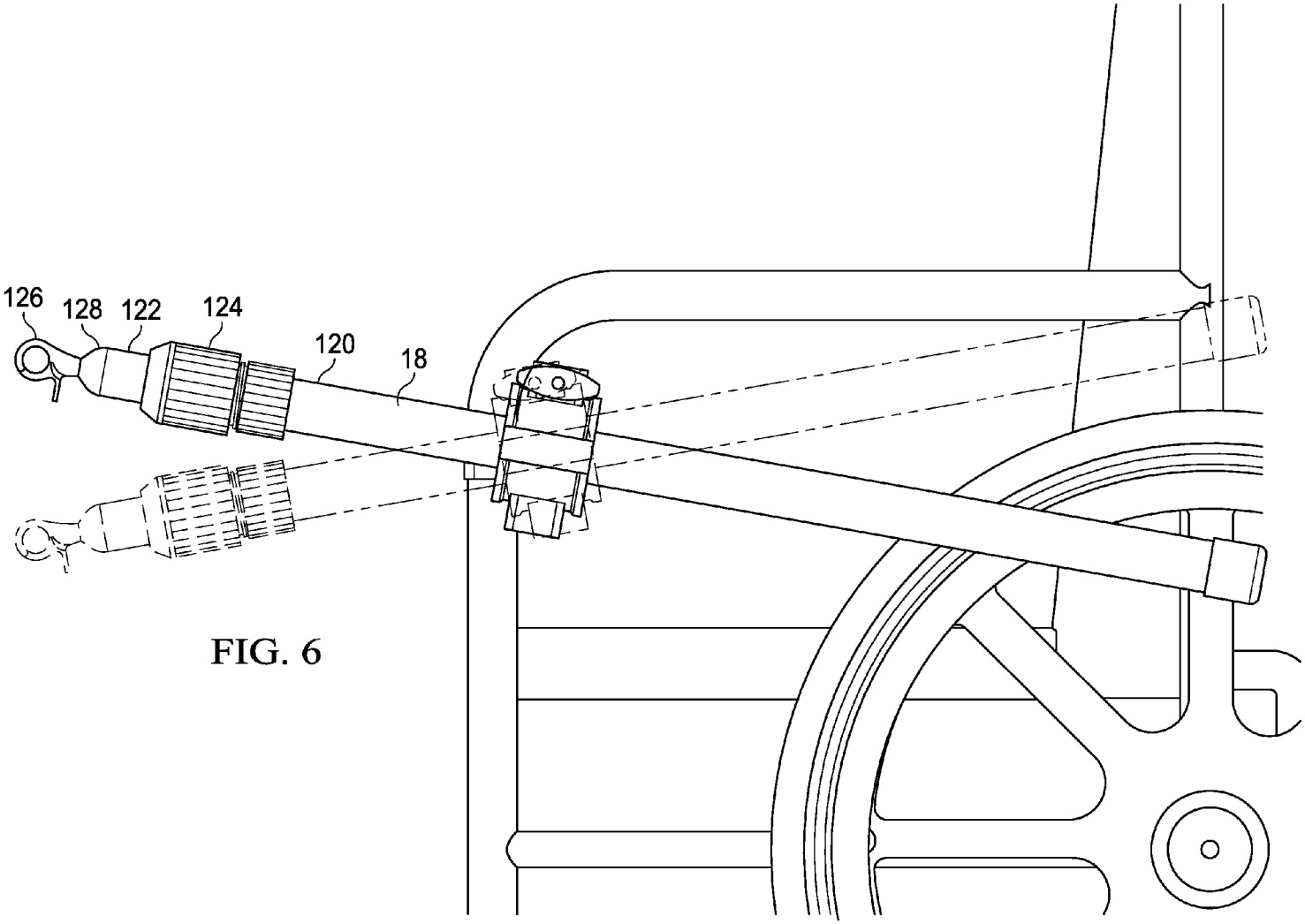
FIG. 6 is a side view of the wheelchair transfer handrail illustrating angular adjustment of the clamp assembly.
Figure 7:
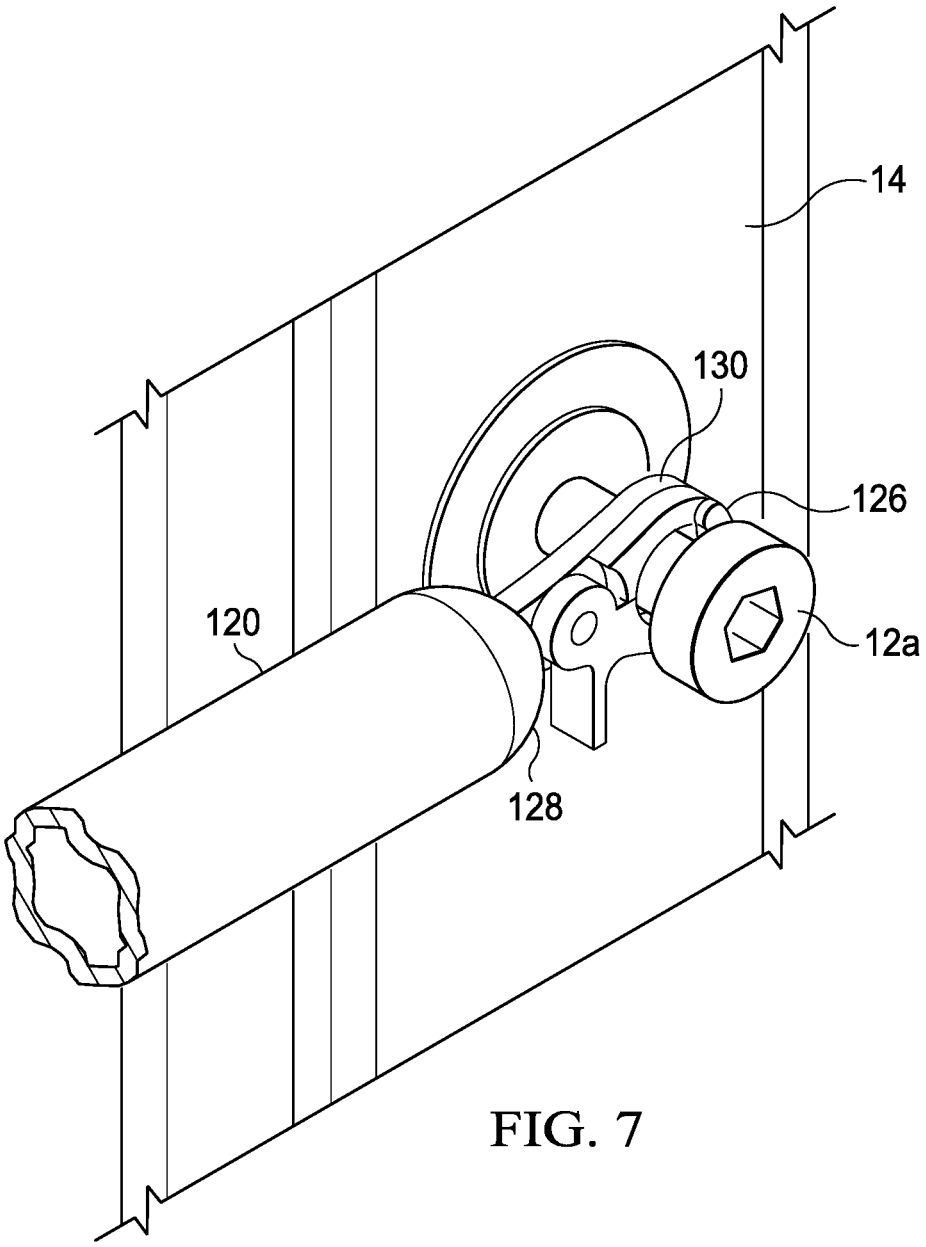
FIG. 7 is a partially broken-away perspective view of a striker connector attached to a post-type door striker.
Figure 8:
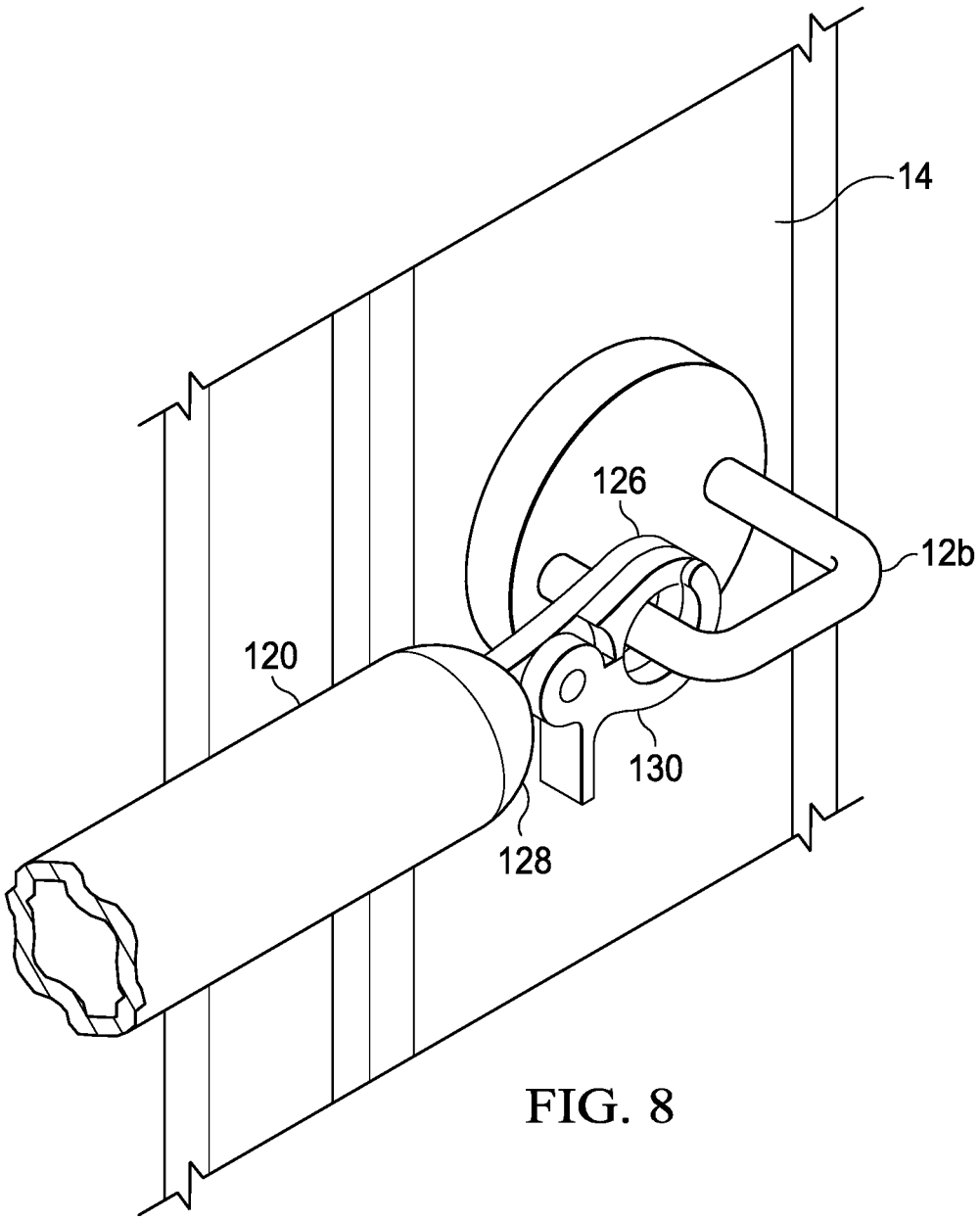
FIG. 8 is a partially broken-away perspective view of a striker connector attached to a U-type door striker.

Base threaded rod 86 and the opening 90 in the base are sized to form a loose fit when the base threaded fastener 94 engaged therewith is loosened, thereby enabling angular adjustment between the planar surfaces 88,92 of the inner half 82 and base 40, and to fix the inner half 82 to the base 40 when the base threaded fastener 94 is tightened. The approximate range of angular adjustment enabled is best shown in FIG. 6. Angular adjustment is needed when connecting to vehicles of different heights, or more specifically door strikers at different heights, or when the length of the handrail tube is changed and the same height at the end of the handrail tube is needed.

A lower side 100 of the outer half 84 is pivotally connected to a lower side 102 of the inner half 82, the outer half 84 being thereby pivot-able between open, loosened and closed positions. The barrel clamp 80 is fixed to the handrail tube 18 when the outer half 84 is in the closed position. Linear relative motion between the barrel clamp 80 and the handrail tube 18 is enabled when the outer half 84 is in the loosened position. This enables the handrail tube 18 to be extended or retracted. The handrail tube 18 may be removed entirely when the outer half 84 is in the open position.

At least one of the inner and outer halves 82,84 of the barrel clamp 80 has resilient material 104 in contact with the handrail tube 18 when the outer half 84 is in the closed position about the handrail tube 18 to non-destructively grip the handrail tube 18.

The barrel clamp 80 further includes a lock between upper sides 106,108 of the inner and outer halves 82,84 of the barrel clamp 80. The lock includes a pivoted barrel threaded rod 110 on the inner half 82 engaged with lock protrusions 112 on the outer half 84, and a barrel threaded fastener 114 engaged with the barrel threaded rod 110, so the outer half 84 may be pivoted outwardly to the loosened position when the barrel threaded fastener 114 is loosened and the barrel threaded rod 110 is pivoted away from the lock protrusions 112. The outer half 84 is locked in the closed position when the barrel threaded rod 110 is pivoted into engagement with the lock protrusions 112 and the barrel threaded fastener 114 is tightened. Thus, the handrail tube 18 is movable relative to the barrel clamp 80 when the barrel threaded fastener 114 is loosened, barrel threaded rod 110 is pivoted out of engagement with lock protrusions 112, and outer half 84 is in the loosened position.

Now turning to the specific details of the handrail tube 18, the handrail tube is an assembly formed of a plurality of telescoping concentric tubes 120,122 (FIG. 6). An outer tube 120 is in contact with the barrel clamp 80, and at least one inner tube 122 is extendable forwardly in a direction away from the outer tube 120. A twist lock 124 associated with the inner and outer tubes 120,122 enables telescoping of the tubes when unlocked and fixing of the tubes when the lock is engaged. Telescoping tubes with a twist lock are well-known, and are commonly found in camera tripods and paint roller extensions, among other things. In one example of the invention, two tubes of about 24 inches in length are provided, for a total extended length of about 48 inches. With the tubes fully telescoped, and the outer tube extended fully forwardly from clamp assembly by loosening the barrel clamp (FIG. 6 showing the outer tube only partially extended), a handrail of about 48 inches between the vehicle and the wheelchair is provided.

A striker connector 126 at an end 128 of the inner tube 120 is provided for connecting the end 128 to the door striker 12*a* or 12*b* on the vehicle pillar 14. Preferably the striker connector 126 is hand-operable between connected and disconnected positions. The striker connector 126 in one embodiment is a snap hook 130 sized for connection and disconnection from both post-type door strikers 12*a* (FIG. 7) and U-type door strikers 12*b* (FIG. 8), which together account for most vehicles in present-day use.

In operation, the clamp assembly from the base outwards and handrail tube are normally disconnected and stored separately until immediately before use of the wheelchair transfer handrail. The clamp flanges, however, will normally have previously been installed on the wheelchair. When the disabled person A (FIG. 2) is ready to go to the vehicle 20, the larger portion of the clamp assembly from the base outwards is readily slid onto and locked to the clamp flanges by way of the connector elements. The handrail tube, if previously removed from the clamp assembly, is then inserted and locked to the barrel clamp. It is also possible to leave the handrail tube in the barrel clamp when connecting or disconnecting the larger portion of the clamp assembly to the clamp flanges. Movement of the person and wheelchair are then accomplished with the telescoping tubes retracted, and the outer tube retracted to the rearwards position with respect to the clamp assembly, as shown in FIG. 1. This enables the handrail tube to not interfere with normal use of the wheelchair, as it would if extended in front of the wheelchair. Once the wheelchair and person are in position adjacent the open vehicle door, with wheels firmly locked, the twist lock of the tubes can be unlocked, or the barrel clamp loosened, or both, to extend the striker connector to the striker. Angular adjustment can be accomplished by a temporary loosening of the base with respect to the inner half of the barrel clamp. The striker connector is connected to the striker, and after all locks are set, then the handrail is available to be used. After transfer, the steps set forth above are reversed. An empty wheelchair can be connected the same way when the person is transferring from the vehicle instead of to the vehicle.

Whereas, the present invention has been described with respect to a specific embodiment thereof, it will be understood that various changes and modifications will be suggested to one skilled in the art, and it is intended to encompass such changes and modifications as fall within the scope of the appended claims.

I claim:

1. A wheelchair transfer handrail for use in connection with a wheelchair and a door striker on a vehicle pillar, comprising:

a clamp assembly connectable to the wheelchair;

a handrail tube extendable from the clamp assembly towards the door striker;

the clamp assembly including at least one flange connectable to the wheelchair, and a base connected to the flange;

the base and flange having connector elements that enable ready connection and disconnection of the base and flange;

the flange being an outer clamp flange;

the connector elements including a pair of opposing, parallel, longitudinal, ears on the outer clamp flange and opposing, parallel, longitudinal, medial grooves between the ears and flange portions of the outer clamp flange, and the connector elements further including a fixed channel and a loosen-able channel on the base, the fixed channel gripping one ear and the loosen-able channel gripping the other ear, the loosen-able channel being formed by a channel plate having a tongue engaged with a groove on the base and an extension engaged with the other ear, and a flange threaded knob engaged with a flange threaded rod extending from the base through an opening formed in the channel plate; and the connector elements fixing the base to the outer clamp flange when the flange threaded knob is tight, and the connector elements having the loosen-able channel enabling disconnection of the base from the outer clamp flange when the flange threaded knob is loose.

2. A wheelchair transfer handrail for use in connection with a wheelchair and a door striker on a vehicle pillar, comprising:

a clamp assembly connectable to the wheelchair;

a handrail tube extendable from the clamp assembly towards the door striker;

the clamp assembly including a base;

a barrel clamp connected to the base;

the barrel clamp having inner and outer halves, with the inner half connected to the base by way of a base threaded rod extending from a planar surface of the inner half through an opening formed in a planar surface on the base, and a base threaded fastener engaged with the base threaded rod and tightened against the base; and the base threaded rod and opening in the base being sized to form a loose fit when the base threaded fastener engaged therewith is loosened, thereby enabling angular adjustment between the planar surfaces of the inner half and base, and to fix the inner half to the base when the base threaded fastener is tightened.

3. The wheelchair transfer handrail of claim 2, with the barrel clamp further including a lock between upper sides of the inner and outer halves of the barrel clamp, the lock including a pivoted barrel threaded rod on the inner half engaged with lock protrusions on the outer half, and a barrel threaded fastener engaged with the barrel threaded rod, where the outer half is in the loosened position when the barrel threaded fastener is loosened, where the outer half may be pivoted outwardly to the open position when the barrel threaded fastener is loosened and the barrel threaded rod is pivoted away from the lock protrusions, and where the outer half is locked in the closed position when the barrel threaded rod is pivoted into engagement with the lock protrusions and the barrel threaded fastener is tightened; and the handrail tube being removable from the barrel clamp when the outer half is in the open position.

4. The wheelchair transfer handrail of claim 3, with at least one of the inner and outer halves of the barrel clamp having resilient material in contact with the handrail tube when the outer half is in the closed position about the handrail tube to non-destructively grip the handrail tube.

5. The wheelchair transfer handrail of claim 4, with the handrail tube being removable from the barrel clamp when the outer half is in the open position.

6. A wheelchair transfer handrail for use in connection with a wheelchair and a door striker on a vehicle pillar, comprising:

a clamp assembly connectable to the wheelchair;

a handrail tube extendable from the clamp assembly towards the door striker;

the clamp assembly including a base;

a barrel clamp connected to the base, the barrel clamp having inner and outer halves;

a lower side of the outer half pivotally connected to a lower side of the inner half, the outer half being thereby pivot-able between open, loosened and closed positions; and the barrel clamp fixed to the handrail tube when the outer half is in the closed position, and with linear relative motion between the barrel clamp and the handrail tube enabled when the outer half is in the loosened position; and with at least one of the inner and outer halves of the barrel clamp having resilient material in contact with the handrail tube when the outer half is in the closed position about the handrail tube to non-destructively grip the handrail tube.

7. A wheelchair transfer handrail for use in connection with a wheelchair and a door striker on a vehicle pillar, comprising:

a clamp assembly connectable to the wheelchair;

a handrail tube extendable from the clamp assembly to the door striker;

the clamp assembly including a base;

a barrel clamp connected to the base, the barrel clamp having open, loosened and closed positions;

where the barrel clamp is fixed to the handrail tube extendable from the clamp assembly to the door striker when in the closed position, and linear relative motion between the barrel clamp and the handrail tube is enabled when the outer half is in the loosened position;

the barrel clamp having inner and outer halves; and the inner and outer halves of the barrel clamp having resilient material in contact with the handrail tube when the outer half is in the closed position about the handrail tube to non-destructively grip the handrail tube.

8. A wheelchair transfer handrail for use in connection with a wheelchair and a door striker on a vehicle pillar, comprising:

a clamp assembly connectable to the wheelchair;

the clamp assembly being connectable to a vertical armrest support of the wheelchair;

with the clamp assembly including inner and outer clamp flanges, each of the clamp flanges having a V-shaped inner surface, the inner surfaces opposed to one another and sized to engage a tubular section of the vertical armrest support, with tighten-able fasteners spanning between opposed openings in the inner and outer clamp flanges, and with the fasteners tighten-able to clamp the flanges to the vertical armrest support;

the clamp assembly including a base connected to the outer clamp flange;

the base and outer clamp flange having connector elements that enable ready connection and disconnection of the base and outer clamp flange;

the connector elements including a pair of opposing, parallel, longitudinal, ears on the outer clamp flange and opposing, parallel, longitudinal, medial grooves between the ears and flange portions of the outer clamp flange, and the connector elements further including a fixed channel and a loosen-able channel on the base, the fixed channel gripping one ear and the loosen-able channel gripping the other ear, the loosen-able channel being formed by a channel plate having a tongue engaged with a groove on the base and an extension engaged with the other ear, and a flange threaded knob engaged with a flange threaded rod extending from the base through an opening formed in the channel plate;

the connector elements fixing the base to the outer clamp flange when the flange threaded knob is tight, and the connector elements having the loosen-able channel enabling disconnection of the base from the outer clamp flange when the flange threaded knob is loose;

a barrel clamp connected to the base;

the barrel clamp having inner and outer halves, with the inner half connected to the base by way of a base threaded rod extending from a planar surface of the inner half through an opening formed in a planar surface on the base, and a base threaded fastener engaged with the base threaded rod and tightened against the base;

the base threaded rod and opening in the base being sized to form a loose fit when the base threaded fastener engaged therewith is loosened, thereby enabling angular adjustment between the planar surfaces of the inner half and base, and to fix the inner half to the base when the base threaded fastener is tightened;

a lower side of the outer half of the barrel clamp pivotally connected to a lower side of the inner half, the outer half being thereby pivot-able between open, loosened and closed positions;

the barrel clamp fixed to a handrail tube extending from the clamp assembly to the do striker when the outer half is in the closed position, and with linear relative motion between the barrel clamp and the handrail tube enabled when the outer half is in the loosened position;

at least one of the inner and outer halves of the barrel clamp having resilient material in contact with the handrail tube when the outer half is in the closed position about the handrail tube to non-destructively grip the handrail tube;

the barrel clamp further including a lock between upper sides of the inner and outer halves of the barrel clamp, the lock including a pivoted barrel threaded rod on the inner half engaged with lock protrusions on the outer half, and a barrel threaded fastener engaged with the barrel threaded rod, where the outer half is in the loosened position when the barrel threaded fastener is loosened, where the outer half may be pivoted outwardly to the open position when the barrel threaded fastener is loosened and the barrel threaded rod is pivoted away from the lock protrusions, and where the outer half is locked in the closed position when the barrel threaded rod is pivoted into engagement with the lock protrusions and the barrel threaded fastener is tightened;

the handrail tube being removable from the barrel clamp when the outer half is in the open position;

the handrail tube being formed of a plurality of telescoping concentric tubes, with an outer tube being in contact with the barrel clamp, and with at least one inner tube extendable forwardly in a direction away from the outer tube;

a twist lock associated with the inner and outer tubes to enable telescoping of the tubes when unlocked and fixing of the tubes when the twist lock is engaged;

a striker connector at an end of the inner tube for connecting the end to the door striker on the vehicle pillar, the striker connector being hand-operable between connected and disconnected positions; and with the striker connector being a snap hook sized for connection and disconnection from both post-type and U-type door strikers.

* * * * *